United States Patent [19]

Freer

[11] Patent Number: 4,913,441

[45] Date of Patent: Apr. 3, 1990

[54] LASER GOLF TRAINING DEVICE

[75] Inventor: Robert N. Freer, West Berlin, N.J.

[73] Assignee: Laser Track, Inc., Blackwood, N.J.

[21] Appl. No.: 229,519

[22] Filed: Aug. 5, 1988

[51] Int. Cl.[4] ..... A63B 69/36

[52] U.S. Cl. ..... 273/186 A; 273/193 A; 273/81 D; 273/81.2

[58] Field of Search ..... 273/186 A, 186 C, 186 R, 273/186 D, 193 R, 193 A, 194 R, 162 R, 81 D, 81.2, 183 D

[56] References Cited

U.S. PATENT DOCUMENTS

| | | | |
|---|---|---|---|
| 2,080,608 | 5/1937 | Hannaford | 273/186 A |
| 2,158,211 | 5/1939 | Aitken | 273/186 A |
| 2,787,470 | 4/1957 | Barrus et al. | 273/186 A |
| 3,070,373 | 12/1962 | Mathews et al. | 273/186 A |
| 3,649,029 | 3/1972 | Worrell | 273/186 C |
| 3,707,291 | 12/1972 | Tredway | 273/183 B |
| 3,744,799 | 7/1973 | Hightower | 273/183 R |
| 3,776,555 | 12/1973 | Hagaman | 273/186 R |
| 3,820,130 | 6/1974 | Cornelison, Jr. et al. | 273/186 R |
| 3,820,133 | 6/1974 | Adorney et al. | 273/186 R |
| 3,820,795 | 6/1974 | Taylor | 273/186 A |
| 3,863,933 | 2/1975 | Tredway | 273/186 A |
| 3,895,366 | 7/1975 | Morris | 273/186 R |
| 3,953,034 | 4/1976 | Nelson | 273/186 C |
| 4,148,096 | 4/1979 | Haas et al. | 362/252 |
| 4,223,891 | 9/1980 | Van Gaasbeek et al. | 273/186 R |
| 4,304,406 | 12/1981 | Cromarty | 273/186 R |
| 4,327,918 | 5/1982 | Foster | 273/186 R |
| 4,456,257 | 6/1984 | Perkins | 273/186 A |
| 4,693,479 | 9/1987 | McGwire | 273/186 A |

*Primary Examiner*—George J. Marlo

*Attorney, Agent, or Firm*—Caesar, Rivise, Bernstein, Cohen & Pokotilow

[57] ABSTRACT

A golf training device having a grip with a top and bottom and longitudinal axis therethrough is provided with a laser light generating mechanism within the grip which generates a laser light beam that projects out of the top of the grip. An obstruction mechanism is positioned in the path of the laser light beam in order to selectively obstruct the emission of the laser light beam from the grip, and a power source is connected to the laser light generator in order to supply power to operate the generator mechanism. In one embodiment, a shaft and golf club head are connected to the bottom of the grip, and in a second embodiment, weights are added to the bottom of the grip to simulate the swing weight of a golf club.

22 Claims, 3 Drawing Sheets

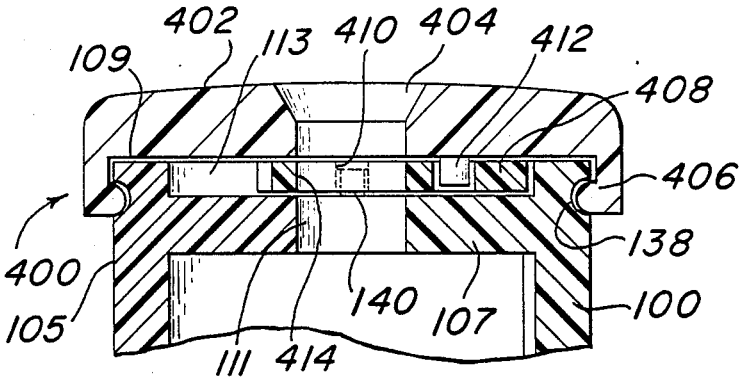
FIG. 4
FIG. 3
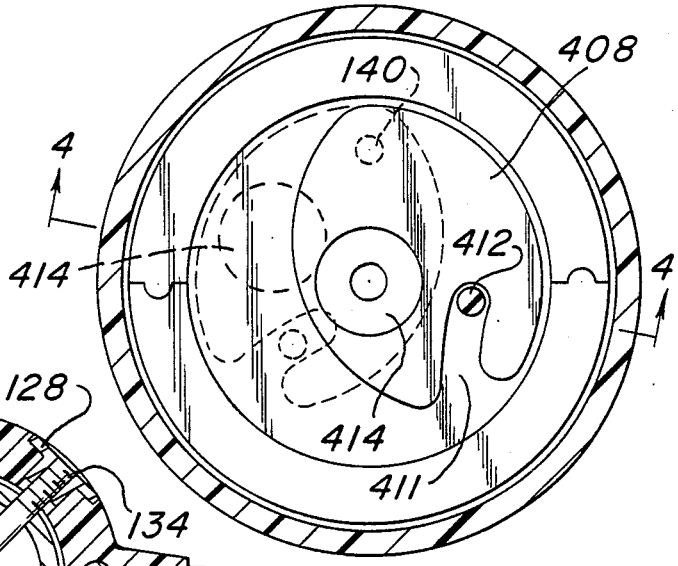
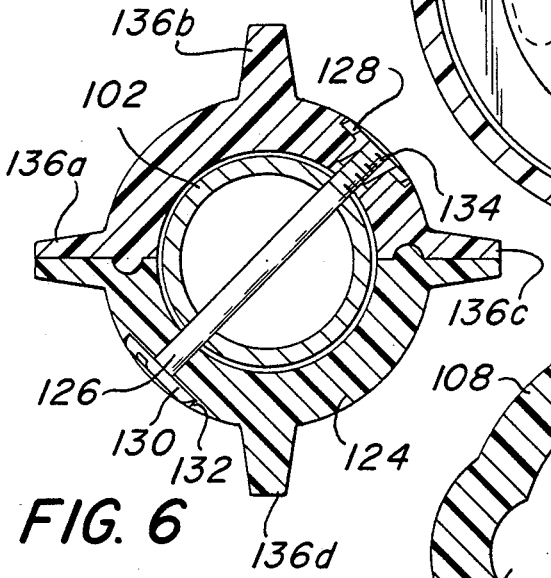
FIG. 6
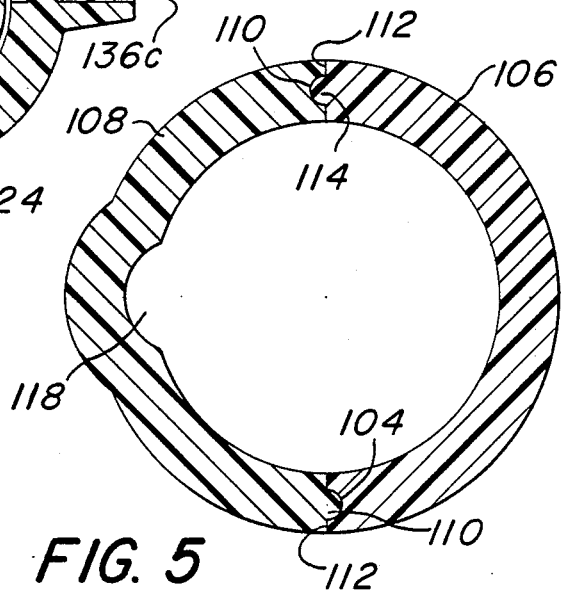
FIG. 5

LASER GOLF TRAINING DEVICE

FIELD OF THE INVENTION

The present invention relates to a training device for improving a golf swing, and in particular, the invention relates to a training device having a laser projecting device therein which projects a laser beam that tracks the plane of the golfer's swing and provides feedback to the golfer about the swing, prior to contact with the golf ball.

BACKGROUND OF THE INVENTION

The flight of a golf ball hit by a golf club may be explained in terms of the physical laws of angular momentum. At the point of impact between the golf club with the golf ball, the golf swing is a circular motion system consisting of a greater circle whose radius, at the time of impact, consists of the arm of the golfer extended by the golf club shaft to the head of the golf club. The direction of the angular momentum at the point of impact is perpendicular to the radius of the greater circle (reference Olenick, Apostol, Goodstein, *The Mechanical Universe Introduction to Mechanics and Heat,* Cambridge University Press, P. 443). The center of this greater circle is approximately at the base of the golfer's neck. It is a requirement that the center of this greater circle remain anchored at a single point in space in order to consistently transfer the optimal angular momentum of the club to the ball at impact. If the golf club is always on the optimal swing plane determined by the target, the ball, and the center of the swing circle, and the swing center remains stationary in space, the ball will be struck automatically as centrifugal force causes the golfer's wrists to unhinge and throw the clubhead out, maximizing its radius at impact. Therefore, we always want to create the same "best" circle for both direction and distance. Stated even more simply, the direction which the golf ball travels is directly related to the plane of the swing.

To produce the optimal velocity toward the target for every swing, the plane of the angular momentum system must act along a line through the ball and toward the target; thus the advice to "follow through". In general, the advice to "keep your head down and follow through" is really, in scientific terms, advice to keep the center of the circle of angular momentum constant and have the swing operate along the line from the ball to the target in order to impart the maximum angular momentum in the desired direction of the shot.

The second significant consideration is the distance the golf ball travels and that is determined by the velocity of the ball immediately after impact by the golf club. Since the weight of the golf ball is fixed and the weight of the golf club is fixed, the velocity of the ball is determined by the velocity of the club head at impact. Therefore, in order to increase distance, the golfer must increase club head speed along the target line at impact with the golf ball.

Therefore, the correct positioning of the swing plane along the target line is essential in order to be able to efficiently transfer the angular momentum from the swing to the ball to get the maximum performance, i.e., the desired direction and distance.

Heretofore, feedback about the position of the golfer's swing plane has been generally available to the golfer only after the golf shot or swing has been completed. By watching the flight of the ball on the driving range, the golfer is trying to relate the feel of the swing to the swing plane that creates the flight characteristics of direction and distance. Examination of the line of the divot is also an after-the-fact attempt to determine the swing plane and relate the after-the-shot feedback to how the swing "felt" while being executed. In order to improve, the golfer must known what were the critical elements of the swing and "remember" how they felt. Thus, up to now, the important steps in teaching golf have been to first impart information about what is important in the swing; then to coach the golfer in how that information translates into the proper feel during the swing; and finally to examine the results after the swing. There has been no way, however, to actually receive feedback about the swing while it is in progress. The golfer could only examine the results of the swing (e.g., distance, direction) and from that "after-the-swing-is-completed" information attempt to make the changes necessary for improvement.

Various patents have issued over the years on training devices designed to improve a golfer's swing. Many of the patents specifically relate to training devices which incorporate various types of light beams to assist in following the motion of the swing. Examples of various patents for these devices include U.S. Pat. Nos: 4,693,479 to McGwire; 2,080,608 to Hannaford; 2,158,211 to Aitken; 3,070,373 to Mathews et al.; 4,456,257 to Perkins; 2,787,470 to Barrus et al.; and 3,820,795 to Taylor.

The McGwire patent (U.S. Pat. No. 4,693,479) discloses a self-contained, detachable device for attachment to golf clubs to provide a visual indication of the position of the club during the swing. The device includes a light bulb attached to one end of a golf club, in an attempt to provide a beam of light extending outwardly away from the grip end of the club, so that the light beam is generated along the same common longitudinal axis as the golf club shaft. The light beam is produced by an incandescent bulb and continuously disperses as the distance from the end of the golf club to the ground increases.

The Hannaford patent (U.S. Pat. No. 2,080,608) discloses a practice stick which is weighted to have the feel of a golf club and which projects from the downward end thereof an incandescent light beam. The light beam which is produced is a transverse, elongated image on the plane surface.

In Aitken (U.S. Pat. No. 2,158,211), a light source is provided for lighting the top of the head of the club and in Taylor (U.S. Pat. No. 3,820,795) a device is disclosed which may be attached to the golf club shaft and which directs a light beam upwardly toward the golfer.

In the Perkins et al. and Mathews et al. patents (U.S. Pat. Nos. 4,456,257 and 3,073,373) additional devices are disclosed which project light beams downward along the golf club shaft to the ground. In addition, in Perkins a light beam may also be projected upwardly from the grip end by means of a fiber optics line within the golf club.

While each of these devices contains a light source for projecting light from one or both ends of the golf club, none of the patents discloses a structure which provides a definite and very distinct collimated light beam. The various incandescent light sources or fiber optic light transmission material disclosed in the patents will project a beam of light from the golf club onto a surface, but the light beam disperses as the distance from the light source to the surface increases, particularly at the top of the backswing. It is not possible, therefore, to get a continuous, distinct point light beam. Such a beam is not possible with the lens system or the fiber optic system presently taught by these various patents.

These prior golf training aids project a light beam onto the desired surface to disclose the plane of the golfer's swing. However, none of the prior devices utilizes a light source which provides a collimated light beam that does not vary in size or disperse with distance from the light source. In making sure that the golfer's swing plane is directly on target with the golf ball, it is not sufficient to have a broadly dispersed light beam. The light beam should be as concentrated as possible and the same width for the entire swing and, moreover, should not need to be readjusted for the height of each person who might use the device.

OBJECTS OF THE INVENTION

With the above background in mind, it is a primary object of the present invention to provide a golf training device which enables a golfer to visualize the path of the golf club relative to the ideal swing plane defined by the center of the swing circle, the ball and the target so that the golfer can utilize eye and hand co-ordination to adjust the backswing and downswing for optimal transfer of the club's angular momentum.

It is also an object of the invention to provide a golf training device which has a laser light source in the grip thereof for producing a collimated light beam that will project from one end of the device along a line coaxial with the longitudinal axis of the grip, and along the swing plane.

It is an object of the invention to provide a golf training device wherein the collimated light beam projects from the top or butt end of the device.

It is yet another object to provide a golf training device having a laser in the grip thereof wherein the laser light beam projecting from the grip can be selectively interrupted.

It is another object of the invention to provide a golf training device having a laser light source in the grip thereof which also has a mechanism to turn the laser on either manually or upon imparting motion to the device.

It is an object of the invention to provide a golf training device having a laser light source in the grip thereof which has an indicator to indicate whether the laser is on or off.

It is another object of the invention to provide a golf training device having a laser light source in the grip thereof which is in the shape of a golf club.

It is also an object of the invention to provide a golf training device having a laser light source therein which is in the shape of a golf club grip, but with no shaft and club head, and which is weighted to simulate the swing weight of a golf club.

SUMMARY OF THE INVENTION

In furtherance of these objectives, a golf training device is provided which has a grip with a top and bottom and a longitudinal axis therethrough. The grip is provided with a laser light generating mechanism which generates a laser light beam that projects out of the top of the grip. An obstruction mechanism is positioned in the path of the laser light beam in order to selectively obstruct the emission of the laser light beam from the grip, and a power source is connected to the laser light generator in order to supply power to operate the generator. In one embodiment, a shaft and golf club head are connected to the bottom of the grip, and in a second embodiment, weights are added to the bottom of the grip to simulate the swing weight of a golf club.

The light projecting from the laser differs from the light produced by other sources, such as electric bulbs, fluorescent lamps, and the sun. The light projecting from these other sources travels in all directions, while the light from a laser is highly directional. The laser light travels in a narrow beam in only one direction, and the sides of the beam stay almost parallel.

It is a contention of this invention that the desired golf swing training benefits can only be produced by an invention which creates the very narrow light beam required to define the swing plane. Because, technically, the optimal swing plane defined by a point at the base of the golfer's neck, the golf ball and the target, has no thickness, the light beam passing along that plane should also be as narrow as possible in order to coincide with the swing plane. Thus, by means of the laser light beam projecting from the top of the grip, the very narrow collimated light from the laser defines precisely the golfer's swing plane and shows whether the swing is in the proper plane through the golf ball and in the direction of the target both during the backswing and the downswing. The collimated light emitting from the grip provides the golfer with a precise line of light which is visable during the backswing and the downswing, giving the golfer feedback prior to impact with the ball which will enable the golfer to correct the swing before hitting the golf ball.

BRIEF DESCRIPTION OF THE DRAWINGS

Other objects and many of the attendant advantages of the instant invention will be readily appreciated as the same becomes better understood by reference to the following detailed description when considered in conjunction with the accompanying drawings wherein:

FIG. 3 is an enlarged sectional view of the end cap of the golf training device of the present invention taken along the line 3—3 in FIG. 2.

FIG. 4 is a sectional view of the end cap of the present invention taken along the line 4—4 in FIG. 3.

FIG. 5 is an enlarged cross-sectional view of the grip of the golf training device of the present invention taken along the line 5—5 in FIG. 2.

FIG. 6 is an enlarged sectional view of the extension portion of the grip of the golf training device of the present invention taken along the line 6—6 in FIG. 2.

DETAILED DESCRIPTION OF THE PREFERRED EMBODIMENT

While the mere existence of the numerous books and training videos on golf atest to the fact that there are many opinions about what is important in a golf swing, it is the contention of this inventor that one of the most important requirements for improving the desired results of the golf swing, i.e., direction and distance, is to give the golfer feedback about the position of the golfer's swing plane, relative to the ideal swing plane while the swing is in progress.

In order to realize the importance to the golfer of receiving feedback about the position of the swing plane as the swing is in progress, it is important first to understand the physical phenomenon of the golf swing. A golf swing prior to impact with the ball can be described in terms of two circles relating to the golfer. The two-circle approach to understanding the arm-golf club swing is represented diagrammatically in FIG. 8, wherein the full sequence of a golf swing is represented.

Figure 8:
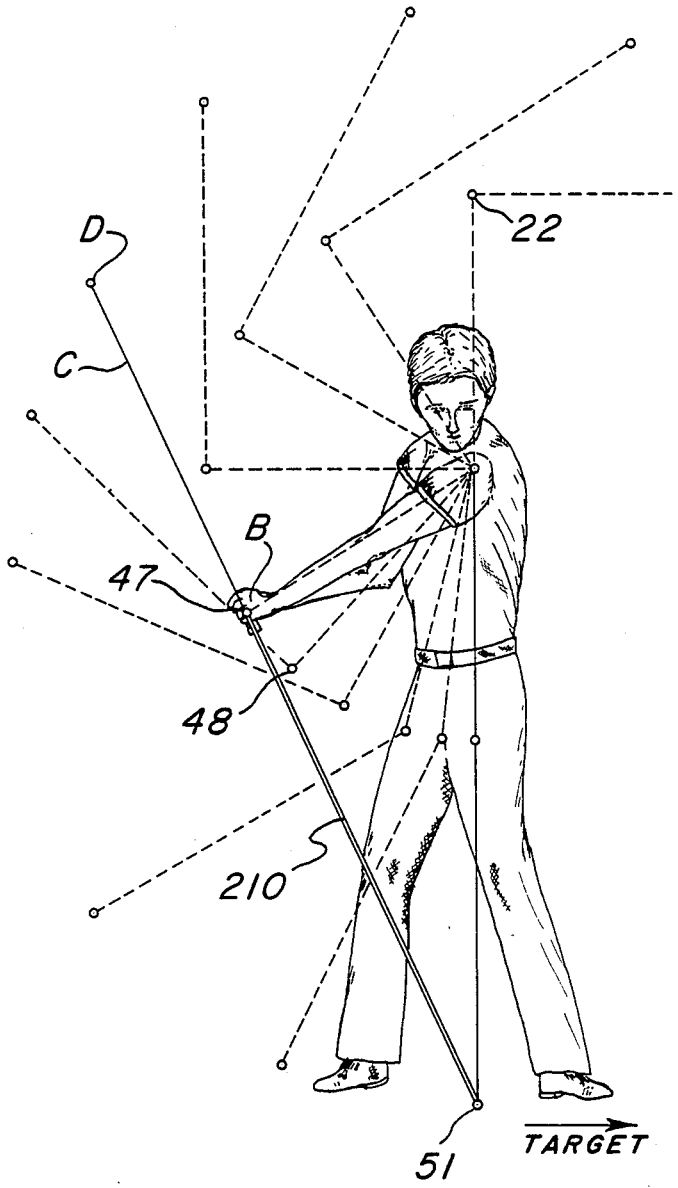
FIG. 8 is a diagrammatic depiction of a golf swing.

By examining FIG. 8 the two circles of the angular momentum system of the swing prior to impact can be seen. The first circle is defined by the radius extending from the center point at the base of the neck A to the golfer's hands B; and the second circle is defined by the radius created by the shaft of the club C extending from the golfer's hands B to the head of the golf club D. For the second circle, the center of the circle is constantly in motion. At 51 the radii of the first and second circles align to form the radius of what may be described as a third or greater circle at the point where angular momentum is imparted to the ball at the bottom of the swing. Even though there is the single greater circle and radius at impact, there are actually two circles operating at every other instant in the swing, from the moment the golfer begins the backswing, through the transition at the top of the swing, point 22, and through every motion and moment until literally the instant before impact, when the radii of the two circles become the single radius of the great circle exactly upon impact with the ball.

With this understanding, it can be seen that the position of the hands B and the orientation of the golf club shaft C, during the swing, are critical to the angular momentum system operating at the point of impact 51. The position of the hands and the orientation of the golf club shaft during the swing define the swing plane of the swing itself, including the angular momentum at the point of impact with the ball. The proper advice for the use of the hands in order to maximize the transference of angular momentum at the moment of impact with the ball, is revealed by considering the diagram in FIG. 8. By the time the golfer's swing is on the forward momentum and has reached point 57, it is impossible to change the physics of the swing even if the golfer should try. At that point, there is so much centrifugal force working on the golfer's hands, arms and club that the path traveled by the club head is automatically dictated by the position of the hands and the orientation of the golf club shaft.

The two lesser circles of the golf swing create the characteristics of the single greater circle, and thus the angular momentum of the greater circle at the instant of impact, work through the momentum of the swing itself.

It is not difficult to understand why feedback during the swing itself, rather than after impact, is so important. The after-the-shot feedback, such as the flight of the ball on the driving range or the direction of the divot, provides information about the swing plane only at the moment of impact, and provides no real-time feedback about the critical factors occurring during the actual swing itself.

Accordingly, for the golfer trying to maximize the effect of the angular momentum system, the critical feedback issues are: where are my hands during the swing and, most particularly, at the critical moment when the centrifugal force begins to come into effect on the forward swing at point 47 in FIG. 8; and how do I get my hands into the optimal swing plane during the controllable portion of the swing, so that the swing imparts the greatest angular momentum to the ball?

These critical feedback questions can be resolved by the training aid of the present invention. Before discussing how the device provides feedback in answer to these issues, it is first necessary to fully understand the device itself.

Figure 1:
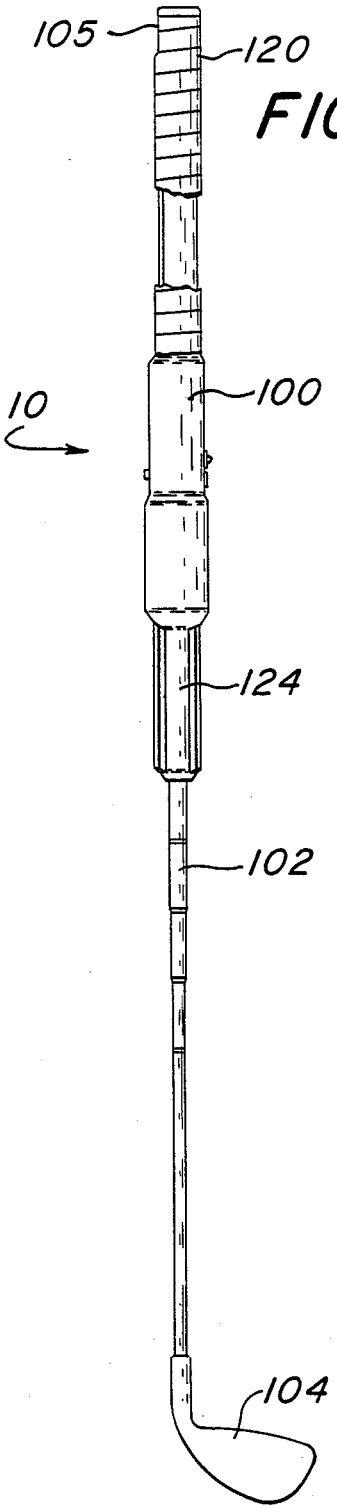
FIG. 1 is a plan view, partially cut away, of the golf training device of the present invention.
Figure 2:
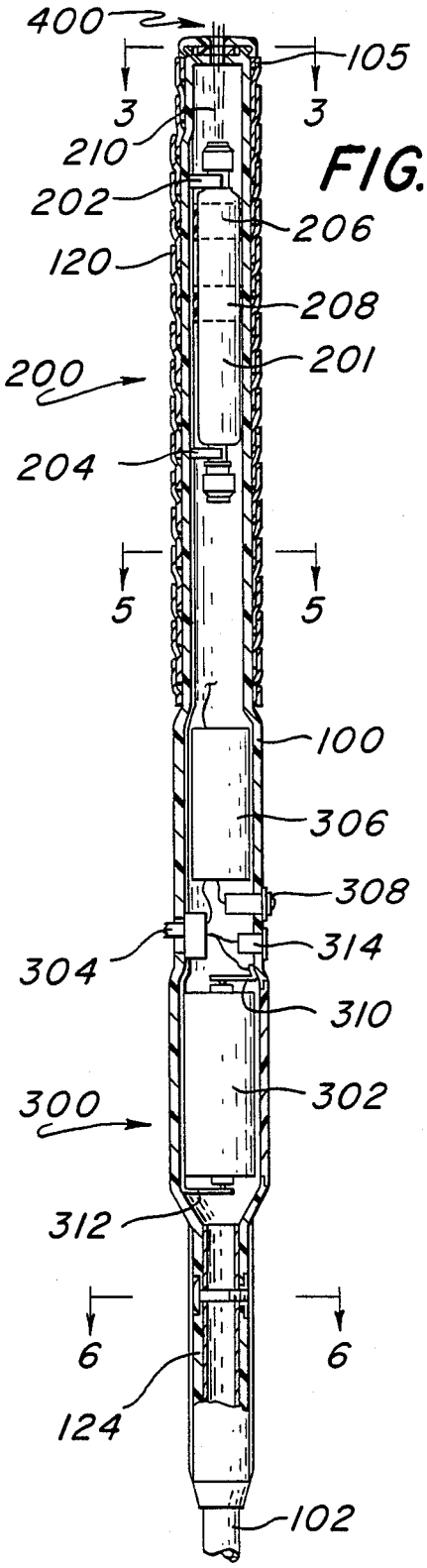
FIG. 2 is an enlarged cut-away view of the grip of the golf training device of the present invention.

Referring now in greater detail to the other figures of the drawings wherein like reference characters refer to like parts, a laser golf training device of the present invention is shown generally at 10 in FIG. 1. In the embodiment shown in FIG. 1, the device 10 is in the shape of a golf club and includes a grip portion 100, a shaft portion 102 extending from grip portion 100 and a club head 104 at the end of the shaft portion 102. Within the grip portion 100 as shown in FIG. 2 is a light source 200, and a power source 300. Fitted at the top end 105 of the grip 100 is a positionable laser light blocking mechanism 400.

As shown more clearly in the cutaway depicted in FIG. 2 and the cross-section in FIG. 5, the grip portion 100 is hollow and formed of two substantially semi-circular molded plastic pieces 106, 108. Each piece 106, 108 has a protrusion 110 on a first edge 112 thereof which is adapted to be received in an groove 114 on the second edge of the other pieces. The plastic is preferably any engineered plastic such as a LEXAN or NORYL (General Electric trademarked products). One molded piece 108 has a second groove 118 therein wherein wiring inside the grip portion 100 may be positioned. The two halves 106, 108 are fitted together as shown in FIG. 5 and surrounded by wrapping 120 such as that used on conventional golf clubs. In one embodiment, the halves 106, 108 are also glued together prior to wrapping.

When the two halves 106, 108 of the grip are apart, it is possible to install the light source 200 and power source 300 therein. The light source 200, as shown in FIG. 2, is preferably a device which produces a specific, concentrated, collimated light beam, such as that produced by a laser generator. One example of such a laser generator is a 0.5 MW helium neon laser tube (Model 05 LHR 625) produced by Melles Griot of San Marcos, Calif. The laser light generator 201 is held in place by mounts 202, 204 affixed to the inside of plastic piece 108. The light generator 201 is also held within grip 100 by foam tape 206, 208 surrounding the light generator, which cushions the light generator within the grip and insures that it is held securely therein when both halves are joined together.

Power for operating the laser generator 201 is provided by the power source 300, and as shown in FIG. 2, the power source 300 includes an energy source 302, an on/off switch 304 between the energy source 302 and the light generator for turning on the flow of energy to the light generator, and a step-up transformer 306 connected between the energy source 302 and the laser generator for increasing voltage between the energy source 302 and the light generator 201. An indicator light 308 is also connected between the on-off switch and the laser, so that it is always possible to visably tell when the power source and light source are engaged.

In the preferred embodiment, the energy source 302 is a 10–12 volt battery held in position by biased electrodes 310, 312. The electrodes 310, 312 are, of course, connected to switch 304. The battery 302 is inserted in the grip 100 through an opening in the grip 100 which has fitted therein a removable cover plate (not shown). It is also possible to provide the source of power outside of the grip 100 by providing an adaptor jack 314 so that a low voltage power source outside the grip (such as a separate 10–12 volt battery pack) or an AC adapter (such as an Archer 12 volt AC adapter Cat. No. 273-1652) can be connected to the jack 314 in a manner known in the art. The power from the energy source 302 to the laser generator 200 is controlled by a manual on-off switch 304 as shown in FIG. 2. It is also possible to provide a motion-type on-off switch (not shown) which turns the power on when the device is in motion.

The grip portion 100 has a hollow extension 124 on the lower end thereof into which fits the upper end of the shaft 102. As shown in FIGS. 2 and 6, the hollow shaft 102 fits frictionally within the extension 124 and is further held in place by a threaded bolt 126 passing through the extension 124 and the shaft 102 and held in place by a threaded fastner 128, such as a threaded nut, on the opposite side of the extension 124. Both the head 130 of the bolt 126 and the fastener 128 fit into recesses 132, 134, respectively within the extension 124 so that the fastener and bolt are at least flush with the sidewall of the extension 124.

As further shown in FIG. 6, the extension 124 of the grip 100 is formed with reinforcing ribs 136(*a–d*) therealong.

In the embodiment shown in FIG. 1, the golf training device 10 of the present invention is constructed in the form of a full-size golf club with a grip portion 100, shaft 102 and head 104. Such a device is readily useable for practicing a golf swing whenever there is sufficient room to swing a full-size golf club. However, oftentimes a golfer may want to practice a golf swing in quarters which are too confined to use a full-size club. Since, as explained above, the real instructional value of the device is the laser beam track emitted from the grip, it is not necessary to have a full golf club in order to produce the swing plane and thus practice a golf swing. Under such circumstances, the device of the invention can be constructed without the full-length shaft 102 and club head 104 as shown in FIG. 7, and the device will be more readily transportable, such as in a briefcase or suitcase.

Figure 7:
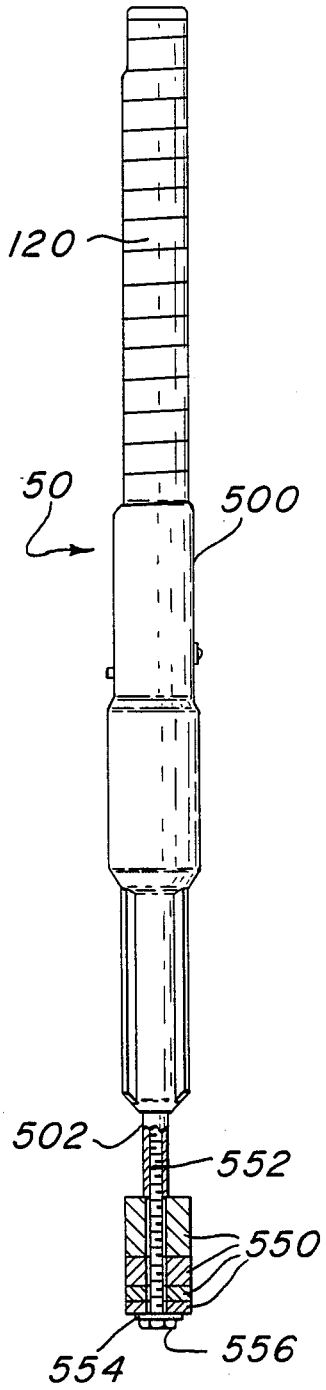
FIG. 7 is a second embodiment of the golf training device of the invention which is shorter than a full-size golf club.

In FIG. 7, the device 50 has a full-sized grip portion 500 similar to FIG. 1, however instead of a full shaft, only the extension 502 at the end of the grip is provided. In order to simulate the weight of a full-size golf club, weights 550 can be added to the extension. The extension 502 of the grip 500 is hollow and threaded on the inside thereof. A fastener 552 is threaded into the hollow extension 502. The weights 550 are preferably in the shape of a washer with a hole in the middle, so that they can easily fit around the fastener 552. Any number of weights may be added until the desired swing weight is attained by simply unthreading the fastener, adding the weights, and reconnecting to the fastener to the extension. A washer 554 is provided between the end 556 of the fastener 552 and the weights 550.

In FIGS. 3 and 4, the light blocking mechanism 400 is shown in detail. The laser generator 201 is positioned in the hollow grip portion 100 such that a beam of light 210 emitted from the generator 201 is coaxial with the longitudinal axis of the shaft. The light blocking mechanism 400 includes an end cap 402 which fits over the top end 105 of the grip 100. The end cap 402 has an opening 404 therethrough which is concentric with the longitudinal axis of the grip portion 100 and through which the beam of light 210 from the laser generator 201 passes. The end cap 402 has an inwardly projecting rim 406 around the lower edge thereof which snap fits into a groove 138 around the outside of the top end 105 of the grip 100. In this manner, the end cap 402 can be rotated about the top of the grip.

The top end 105 of the grip 100 has a top wall 107 thereacross slightly recessed below the top edge 109 of the grip 100. At the center of the top wall 107 is an opening 111 which is also concentric with the longitudinal axis of the grip 100. Mounted onto the top wall 107 within the recess 113 above the top wall 107 is a cam member 408 having a first circular opening 410 therein which fits around a pin member 140 projecting upward from the top wall 107. The cam member 408 is pivotable about the pin member 140 within the recess.

As more fully shown in FIG. 3, the cam member 408 has a groove 411 therein which slidably engages a pin member 412. The pin member 412 projects downwardly from the underside of the end cap 402, whereby rotating the end cap causes the pin 402 to engage the cam member 408 within the groove 411 and thus pivot the cam member 408 about the pin 140 on the top wall 107. The ability to rotate the cam 408 is important because the cam 408 is designed with a second opening 414 therethrough, which, when the cam is rotated, coaxially aligns with the opening 404 in the cap 402 and the opening 111 in the top wall 107. When all three openings 111, 414 and 404 are concentric (FIG. 4) they are also concentric with the longitudinal axis of the grip 100 and light from the laser generator 201 can shine therethrough and out the top end 105 of the grip. By rotating the cam 408 (by turning the end cap 402) to position shown in the dashed lines in FIG. 3, the opening 414 moves out of alignment with the other concentric openings and the transmission of the light out of the end of the grip is effectively blocked.

Now, in order to understand how the laser track device provides the critical feedback to the questions raised earlier, it is simply necessary to turn on the laser generator 201 by means of the on/off switch 304 connected to the energy source 302 and view the laser beam 210 created thereby shining out of the top 105 of the grip through the concentric openings as an extension of the radius of the golf club shaft circle (FIG. 8). The laser beam 210 is simply the radius of the angular momentum system created by the golf club shaft circle and the swing of the club head about the hands. Thus, as a result of the angular momentum, the club head will travel in the circle defined by the laser radius along the axis of the club shaft to the ball. If the radius defined by the laser tracks the target line through the ball, by point 47, centrifugal force causes the club to strike the ball at point 51, providing maximum angular momentum toward target. Furthermore, if the laser track created by the golfer's swing between point 47 and point 48 is along the line from the ball to the target, the laser track, and thus the lesser golf club shaft circle radius, must be operating along the target line. Since angular momentum always acts perpendicular to the radius of the circle, maximum angular momentum for any given swing is transferred to the ball in the direction of the target when the laser track is along the target line.

Since it is virtually impossible to change the characteristics of the swing after point 47 of the forward swing, feedback which allows real time correction must be provided during the backswing, and the beginning of the forward swing when the golfer can consciously change the circular characteristic of the swing. The laser beam track 210 emitting from the device 10 provides the golfer with critical feedback on the the position of the hands and the orientation of the golf club shaft. If the laser beam track 210 passes over the ball along the target line (the line from the ball to the target) it is traveling in the optimal swing plane required to transfer maximum angular momentum to the ball during the forward swing and thus at impact. Therefore, the laser track device provides critical real-time feedback to the golfer, allowing him to use eye-hand coordination about the position of the hands and the club during both the backswing and the forward swing and thus develops the feel required to improve accuracy and increase distance along the target line. Subsequent repeated use reestablishes that feel—when even good golfers lose it over a period of time.

Without further elaboration, the foregoing will so fully illustrate my invention that others may, by applying future knowledge, adopt the same for use under various conditions of service.

What is claimed as the invention is:

1. A golf training device comprising:

grip means for holding said device, said grip means being hollow and having a top and bottom with a longitudinal axis therethrough;

laser light generating means within said grip means for generating a laser light beam and projecting said laser light beam out of said grip means;

obstruction means in the path of said laser light beam generated by said generating means for obstructing said laser light beam and preventing said laser light beam from projecting out of said grip means; and power supply means, connected to said laser light generating means for supplying power to operate said laser light generating means.

2. A device as claimed in claim 1 further comprising:

a shaft connected to the bottom of said grip means; and a golf club head connected to said shaft.

3. An apparatus as claimed in claim 1, wherein said power supply means is mounted within said grip means.

4. A golf training device as claimed in claim 1, wherein said power supply means is comprised of a battery.

5. A device as claimed in claim 3, wherein said power supply means is comprised of a battery and a step-up transformer.

6. A device as claimed in claim 1, wherein said power supply is comprised of an adaptor jack on said grip means,, and a power source outside said grip means adapted to be connected to said adaptor jack.

7. A device as claimed in claim 6, wherein said power source is an AC converter.

8. A device as claimed in claim 6, wherein said power source is a low voltage battery pack.

9. A device as claimed in claim 8, wherein said power source is a 10–12 volt battery.

10. A device as claimed in claim 1, further comprising on/off indicator means connected to said laser light generating means and said power supply means for indicating when said laser light generating means is activated.

11. A device as claimed in claim 1, further comprising on/of switch means connected to said power supply means for turning said power supply means on and off.

12. A device as claimed in claim 1, wherein said obstruction means is fitted over the top of said grip means in the path of said laser light beam generated by said laser light generating means.

13. A device as claimed in claim 12, wherein said obstruction means is comprised of a cam member pivotably mounted on said grip means and movable into and out of the path of said laser light beam.

14. A device as claimed in claim 13, wherein said cam member has an opening therethrough through which said laser light beam passes when said opening is in alignment with said laser light beam.

15. A device as claimed in claim 13, wherein said obstruction means further comprises a cap member fitted over the end of said grip means and operatively connected to said cam member for pivoting said cam member.

16. A device as claimed in claim 1, wherein said laser light generating means is mounted within said grip means such that said laser light beam generated by said generating means emits from the top of said grip means coaxially with the longitudinal axis of said grip means.

17. A device as claimed in claim 1, further comprising weight means on the bottom end of said grip means for simulating the swing weight of a golf club.

18. A golf training device adapted to be connected to a power source, said device comprising:

grip means for holding said device, said grip means being hollow and having a top and a bottom and a longitudinal axis therethrough; and light generating means within said grip means for generating a collimated light beam and projecting said collimated light beam out of said grip means, said light generating means being adapted to be connected to said power source.

19. A device as claimed in claim 18, further comprising obstruction means moveable into the path of said collimated light beam generated by said light generating means for obstructing said light beam and preventing said light beam from projecting out of the said grip means.

20. A device as claimed in claim 18, wherein said light generating means is mounted within said grip means such that said collimated light beam generated by said light generating means emits from the top of said grip means coaxially with the longitudinal axis of said grip means.

21. A golf training device adapted to be connected to a power source, said device comprising:

grip means for holding said device, said grip means being hollow and having a top and a bottom and a longitudinal axis therethrough;

light generating means within said grip means for generating a collimated light beam and projecting said collimated light beam out of said grip means, said light generating means being adapted to be connected to said power source; and obstruction means movable into the path of said collimated light beam generated by said light generating means for obstructing said light beam and preventing said light beam from projecting out of said grip means.

22. A device as claimed in claim 21, wherein said light generating means is mounted within said grip means such that said collimated light beam generated by said light generating means emits from the top of said grip means coaxially with the longitudinal axis of said grip means.

* * * * *